US011406238B2

(12) United States Patent
Li et al.

(10) Patent No.: US 11,406,238 B2
(45) Date of Patent: Aug. 9, 2022

(54) AUTONOMOUS CLEANING ROBOT

(71) Applicant: Shenzhen Rock Times Technology Co., Ltd., Shenzhen (CN)

(72) Inventors: Xing Li, Shenzhen (CN); Song Peng, Shenzhen (CN); Youcheng Lu, Shenzhen (CN)

(73) Assignee: Shenzhen Rock Times Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/395,564

(22) Filed: Aug. 6, 2021

(65) Prior Publication Data

US 2021/0361138 A1 Nov. 25, 2021

Related U.S. Application Data

(63) Continuation of application No. 16/330,395, filed as application No. PCT/CN2017/113960 on Nov. 30, 2017, now Pat. No. 11,109,730.

(30) Foreign Application Priority Data

Jan. 26, 2017 (CN) ..... 201710061574.3

(51) Int. Cl.
*A47L 11/28* (2006.01)
*A47L 9/06* (2006.01)
(Continued)

(52) U.S. Cl.
CPC ..... *A47L 11/28* (2013.01); *A47L 9/0477* (2013.01); *A47L 9/0686* (2013.01);
(Continued)

(58) Field of Classification Search
CPC ..... A47L 11/28; A47L 9/0477; A47L 9/0686; A47L 11/4005; A47L 11/4016;
(Continued)

(56) References Cited

U.S. PATENT DOCUMENTS 8,898,844 B1 * 12/2014 Dooley ..... A47L 11/408 15/98
10,292,553 B1 * 5/2019 Ebrahimi Afrouzi ..... A47L 5/00
(Continued)

FOREIGN PATENT DOCUMENTS

CN 201939277 U 8/2011
CN 202445993 U 9/2012
(Continued)

OTHER PUBLICATIONS

Extended European Search Report issued in corresponding European Patent Application No. 21195129.8 dated Jan. 5, 2022.
(Continued)

*Primary Examiner* — David Redding
(74) *Attorney, Agent, or Firm* — Morgan, Lewis & Bockius LLP

(57) ABSTRACT

The present disclosure relates to a liquid container and an autonomous cleaning robot. The liquid container may include a container case and a cleaning cloth that is removable and mounted on the container case. The cleaning cloth may include a first guiding member disposed thereon. The container case may include a second guiding member. The first guiding member and the second guiding member cooperate with each other to define an assembly direction of the cleaning cloth. The cleaning cloth can be installed correctly by defining the assembly direction of the first guiding member and the second guiding member.

14 Claims, 19 Drawing Sheets

(51) Int. Cl.
*A47L 11/40* (2006.01)
*A47L 9/04* (2006.01)

(52) U.S. Cl.
CPC ..... *A47L 11/4005* (2013.01); *A47L 11/4016* (2013.01); *A47L 11/4027* (2013.01); *A47L 11/4041* (2013.01); *A47L 11/4058* (2013.01); *A47L 11/4072* (2013.01); *A47L 11/4083* (2013.01); *A47L 11/4088* (2013.01); *A47L 2201/04* (2013.01); *A47L 2201/06* (2013.01)

(58) Field of Classification Search
CPC ..... A47L 11/4027; A47L 11/4041; A47L 11/4058; A47L 11/4072; A47L 11/4083; A47L 11/4088; A47L 2201/04; A47L 2201/06; A47L 2201/00; A47L 9/0466; A47L 11/4036; A47L 11/408; A47L 11/4094
See application file for complete search history.

(56) References Cited

U.S. PATENT DOCUMENTS

| | | | | |
|---|---|---|---|---|
| 2007/0061040 | A1 | 3/2007 | Augenbraun et al. | |
| 2012/0199006 | A1 | 8/2012 | Swett et al. | |
| 2013/0174371 | A1 | 7/2013 | Jones et al. | |
| 2014/0223678 | A1 | 8/2014 | Chiu et al. | |
| 2016/0150934 | A1* | 6/2016 | Kim | A47L 9/009 15/300.1 |
| 2017/0156559 | A1 | 6/2017 | Krebs et al. | |

FOREIGN PATENT DOCUMENTS

| | | | |
|---|---|---|---|
| CN | 204379171 | U | 6/2015 |
| CN | 204600371 | U | 9/2015 |
| CN | 204698453 | U | 10/2015 |
| CN | 205181254 | U | 4/2016 |
| CN | 106108776 | A | 11/2016 |
| JP | S63-008856 | U | 1/1988 |
| JP | H09-6516 | A | 1/1997 |
| JP | H11-99112 | A | 4/1999 |
| JP | 2004-202149 | A | 7/2004 |
| JP | 2008-061678 | A | 3/2008 |
| JP | 2011-030665 | A | 2/2011 |
| JP | 2012-115347 | A | 6/2012 |
| JP | 3194306 | U | 11/2014 |
| JP | 2016-107094 | A | 6/2016 |
| KR | 10-1015465 | B1 | 2/2011 |
| KR | 10-2012-0042391 | A | 5/2012 |
| KR | 10-2012-0129192 | A | 11/2012 |
| WO | 2016/107577 | A1 | 7/2016 |

OTHER PUBLICATIONS

Office Action issued in related U.S. Appl. No. 17/395,547 dated Dec. 15, 2021.
Extended European Search Report issued in corresponding European Patent Application No. 21195096.9 dated Jan. 21, 2022.
Notice of Reasons for Refusal issued in counterpart Japanese Patent Application No. 2021-059030 dated Mar. 20, 2022.
Notice of Reasons for Refusal issued in counterpart Japanese Patent Application No. 2021-059036 dated Mar. 20, 2022.

* cited by examiner

AUTONOMOUS CLEANING ROBOT

CROSS-REFERENCE TO RELATED APPLICATION

This application is a continuation application of U.S. application Ser. No. 16/330,395, which is based upon and claims priority to a Chinese patent application No. 2017100615743 titled "AUTONOMOUS CLEANING ROBOT" and filed on Jan. 26, 2017. The entirety of the above-mentioned application is hereby incorporated by reference herein.

TECHNICAL FIELD

The present disclosure relates to cleaning equipment, and more particularly to a liquid container and autonomous cleaning robot.

BACKGROUND

With the development of technology, a variety of autonomous cleaning robots have appeared, for example, automatic sweeping robots, automatic mopping robots, and so on. An autonomous cleaning robot can automatically perform cleaning operations in a user-friendly way. Taking the automatic sweeping robot as an example, the automatic sweeping robot can automatically clear an area by scraping and using vacuum cleaning technology. The scraping operation can be achieved by automatically cleaning the bottom of the device with a scraper and a roller brush.

For an autonomous cleaning robot with a mopping function, it is often needed to set up a water tank on the robot to provide the water source required for the mopping. Normally, the water tank is connected to the robot at a bottom thereof. The bottom of the robot always needs to be turned upside down to install or disassemble the water tank therefrom.

SUMMARY

Embodiments of the present disclosure provide a liquid container and an autonomous cleaning robot.

Embodiments of the present disclosure provide a liquid container of an autonomous cleaning robot. The liquid container may include a container case and a removable cleaning cloth mounted on the container case. The cleaning cloth may include a first guiding member disposed thereon. The container case may include a second guiding member disposed thereon. The first guiding member and the second guiding member may cooperate with each other and define an assembly direction of the cleaning cloth.

According to another aspect of the present disclosure, embodiments of the present disclosure provide an autonomous cleaning robot. The autonomous cleaning robot may include a main body and a cleaning assembly. The cleaning assembly is mounted on the main body. The cleaning assembly includes a first cleaning subassembly that is detachably mounted on the main body. When the first cleaning subassembly is loaded or removed from the main body, the first cleaning subassembly moves in the forward direction or the backward direction of the main body. The first cleaning subassembly includes a liquid container mentioned above.

DETAILED DESCRIPTION

In the following, the liquid container and the intelligent cleaning apparatus of the embodiment of the present disclosure will be described in detail with attached drawings.

Definition of Nouns

Use of the terminology "forward" refers to the primary direction of motion of the autonomous cleaning robot.

Use of the terminology "backward" refers to the opposite direction of primary direction of motion of the autonomous cleaning robot.

The embodiment of the present disclosure provides a liquid container for an autonomous cleaning robot. The cleaning cloth is provided with the first guiding member, the container case is provided with a second guiding member, and the first guiding member and the second guiding member cooperate with each other and define an assembly direction of the cleaning cloth. The cleaning cloth is connected to the container case by the first guiding member and the second guiding member, and one edge of the cleaning cloth is fixed by the first guiding member to ensure that the direction and position of the cleaning cloth are correct and the deviation of the cleaning cloth is prevented. In this way, the problems caused by using other ways to fix the cleaning cloth, such as that the assembly direction cannot be limited or the correct installation of cleaning cloth 4 cannot be corrected, is solved. The problem of a bad cleaning effect caused by sticking the cleaning cloth to the tank during usage is also solved.

Figure 27:
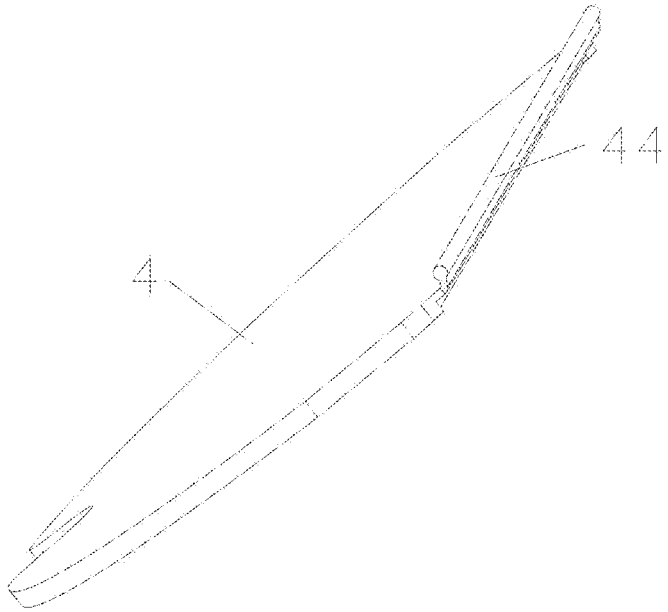
FIG. 27 illustrates a schematic view of a cleaning cloth of an autonomous cleaning robot, in accordance with embodiments of the present disclosure.
Figure 28:
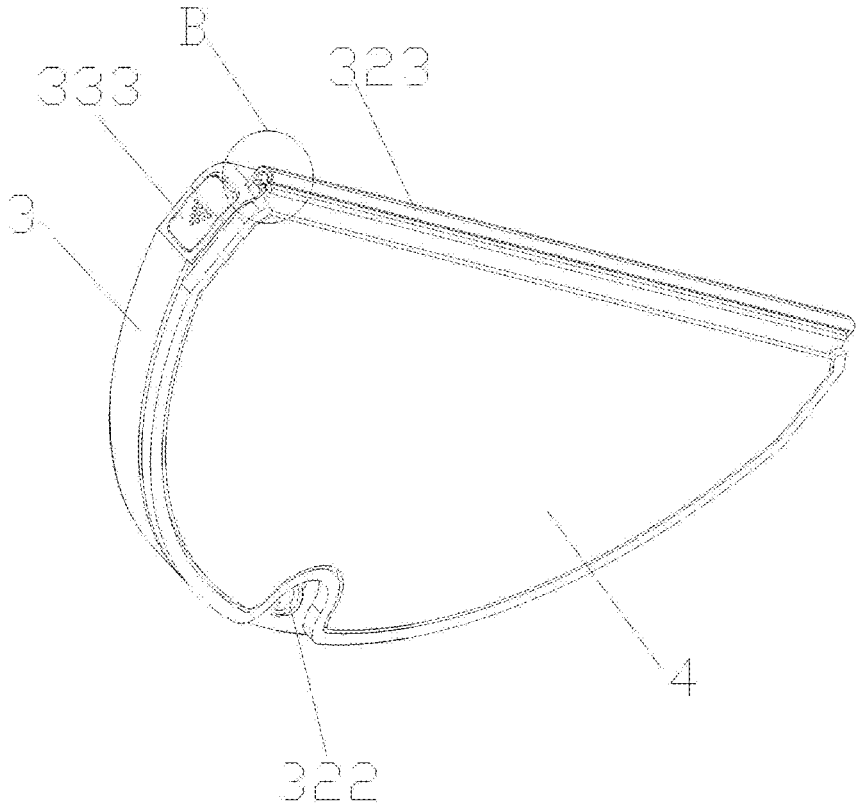
FIG. 28 illustrates a schematic view of a liquid container and a cleaning-cloth fit of an autonomous cleaning robot, in accordance with embodiments of the present disclosure.
Figure 29:
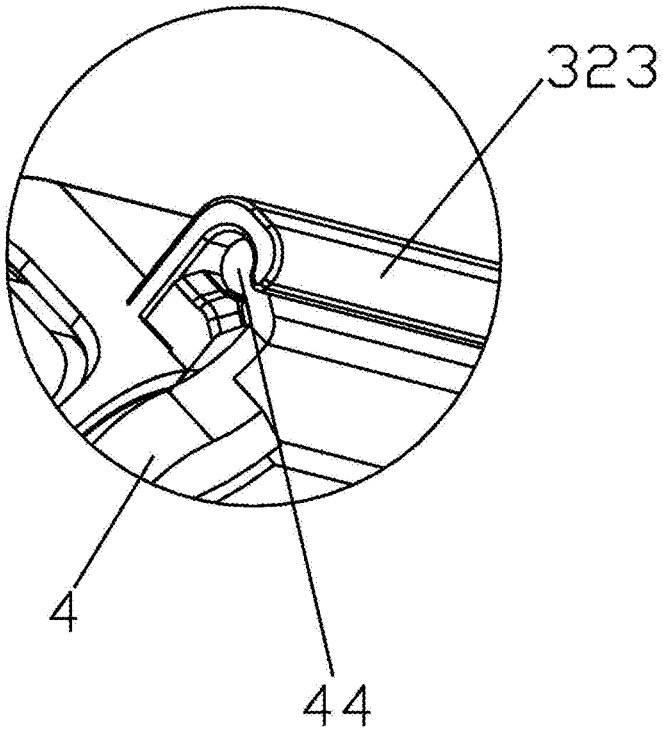
FIG. 29 is a partial enlarged view of B in FIG. 28.

As shown in FIGS. 27-29, the cleaning cloth 4 may include a fixing portion on one side thereof. The first guiding member is mounted on the fixing portion. For example, the cleaning cloth 4 is semicircular, and the fixing portion is mounted on the straight side of the cleaning cloth 4.

In some embodiments, the first guiding member may include a guiding groove. The second guiding member may include a guiding rod engaged with the guiding groove. The guiding rod can be inserted into the guiding groove, and that could restrict the movement of the cleaning cloth 4 relative to the container case.

Of course, in another case, the first guiding member may include a guiding strip 44, the second guiding member may include a mounting groove 323 defined thereon, and the guiding strip 44 could be inserted and fixed in the mounting groove 323 to limit the movement of the cleaning cloth 4 relative to the container case.

The guiding strip 44 is fixed to the cleaning cloth 4 via a connecting section. The connecting section may be integrated with the cleaning cloth 4. For example, as part of the cleaning cloth 4, the guiding strip 44 is fixed thereto by bonding or the like. The mounting groove 323 is provided with a notch for avoiding the connecting portion. The first end of the mounting groove 323 is provided with an opening for the guiding strip 44 passing through, and the second end of the mounting groove 323 is provided with a stop structure.

In some embodiments, the guiding strip 44 is fixedly provided on the side of the cleaning cloth 4 and a mounting groove 323 is provided in the liquid container 3. The guiding strip 44 penetrates the mounting groove 323 and defines the side of the cleaning cloth 4 on the liquid container 3.

The guiding strip 44 may be a plastic rod or a steel rod having a certain rigidity, or it may be a flexible strip. The cross-sectional shape of the guiding strip 44 may be circular or noncircular in other shapes. The cross-sectional shape of the mounting groove 323 on the liquid container 3 is a C-shape or a shape like the C-shape, but the guiding strip 44 must be able to be accommodated and defined. The opening (i.e., the opening of the C-shape) protruding from the connecting section on the cleaning cloth 4 of the mounting groove 323 faces downward. The first end of the mounting groove 323 is a projecting end (the end has no stop structure that extends into the guiding strip 44). The second end is a stop end (this end has a stop structure to prevent the guiding strip from coming out of the end). In other words, one end of the mounting groove 323 is closed and the other end is open. The tail portion of the cleaning cloth 4 is fixed to the liquid container 3 by the engagement of the guiding strip 44 with the mounting groove 323 to improve the fixing stability and prevent the cleaning cloth 4 from falling off. The guiding strip 44 and the mounting groove 323 are located in the direction of the liquid container 3 toward the front of the robot. By this means, the cleaning cloth 4 is attached to Velcro to ensure that the cleaning cloth is properly installed.

The container case is also fixedly provided with an auxiliary fixing structure, and the cleaning cloth 4 is fixed to the container case by the auxiliary fixing structure. In the embodiments of the present disclosure, the auxiliary fixing structure may be an adhesive structure, for example a Velcro or a double-sided adhesive or the like. This auxiliary fixed structure is fixed and reliable, and the structure is simple.

Figure 26:
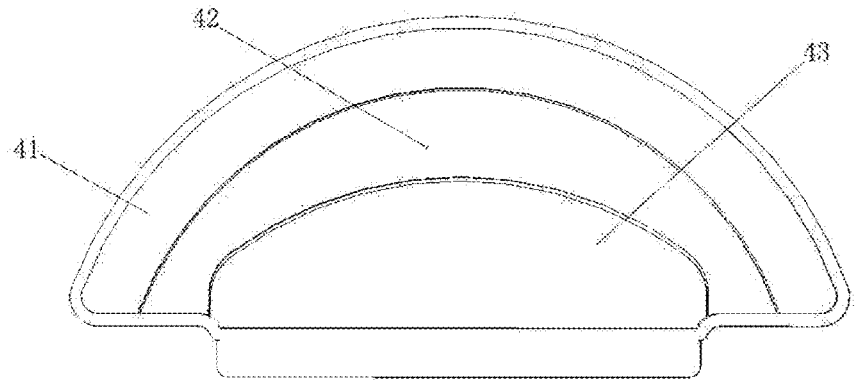
FIG. 26 illustrates a schematic view of a cleaning cloth of an autonomous cleaning robot, in accordance with embodiments of the present disclosure.

In some embodiments, the cleaning cloth 4 is a semicircular shape, and the cleaning cloth 4 may include a water-seepage area, a decontamination area and a water-absorption area. As shown in FIG. 26, the cleaning cloth 4 may be a cleaning cloth of the same material as a whole, or a composite cleaning cloth having a different material in different portions. In the embodiments of the present disclosure, the cleaning cloth 4 is a composite cleaning cloth. The cleaning cloth main body is substantially semicircular. An inner layer 43 of the cleaning cloth is a water-seepage area with high permeability material. A middle layer 42 of the cleaning cloth is a decontamination area with a harder material and used to scrape off the harder material on the ground. An outer layer 41 of the cleaning cloth is a water-absorption area with better water-absorption material used to absorb the water on the bottom surface and remove the water stains. Therefore, the cleaning efficiency is improved. The guiding strip 44 is provided on a semicircular straight-line segment.

According to another aspect of an embodiment of the present disclosure, an autonomous cleaning robot is provided. The autonomous cleaning robot may include a main body 1 and a cleaning assembly. The main body 1 is configured to carry other assemblies mounted on the main body 1. The cleaning assembly may include a first cleaning subassembly 2 detachably mounted on the main body 1. When the first cleaning subassembly 2 is loaded into or removed from the main body 1, the first cleaning subassembly 2 moves in the forward direction of the main body 1. The first cleaning subassembly 2 may include a liquid container 3 mentioned above. When the first cleaning subassembly 2 is mounted on the main body 1 or is removed from the main body 1, the first cleaning subassembly 2 is moved in the forward direction (or the backward direction) of the main body 1 so that the loading and removal of the first cleaning subassembly 2 is more convenient, and the problem that the bottom of the robot always needs to be turned upside down to install or disassemble the water tank therefrom can be solved. Normally, the forward direction of the main body 1 is in the horizontal direction so that the loading and removal of the first cleaning subassembly 2 is more convenient. In the embodiments of the present disclosure, the edge of the cleaning cloth 4 on the liquid container 3 is fixed to the container case of the liquid container 3 through the first guiding member and the second guiding member, thereby restricting the installation location of the cleaning cloth 4, preventing the cleaning cloth 4 from being hooked with the obstructions during work and ensuring the cleaning effect and safety.

Figure 1:
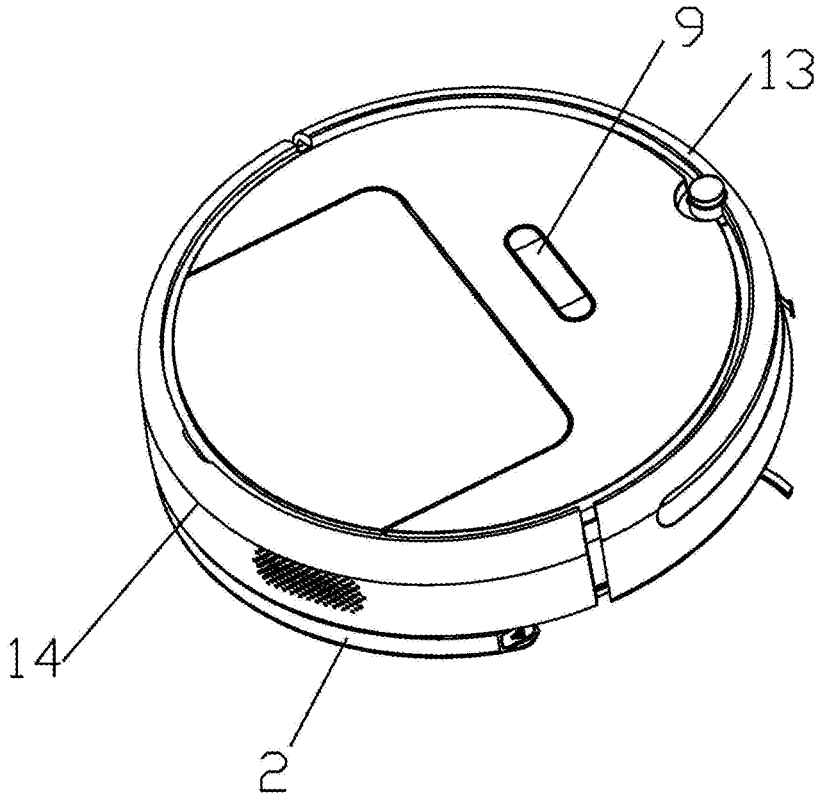
FIG. 1 illustrates a schematic view of a first view of an autonomous cleaning robot, in accordance with embodiments of the present disclosure.
Figure 2:
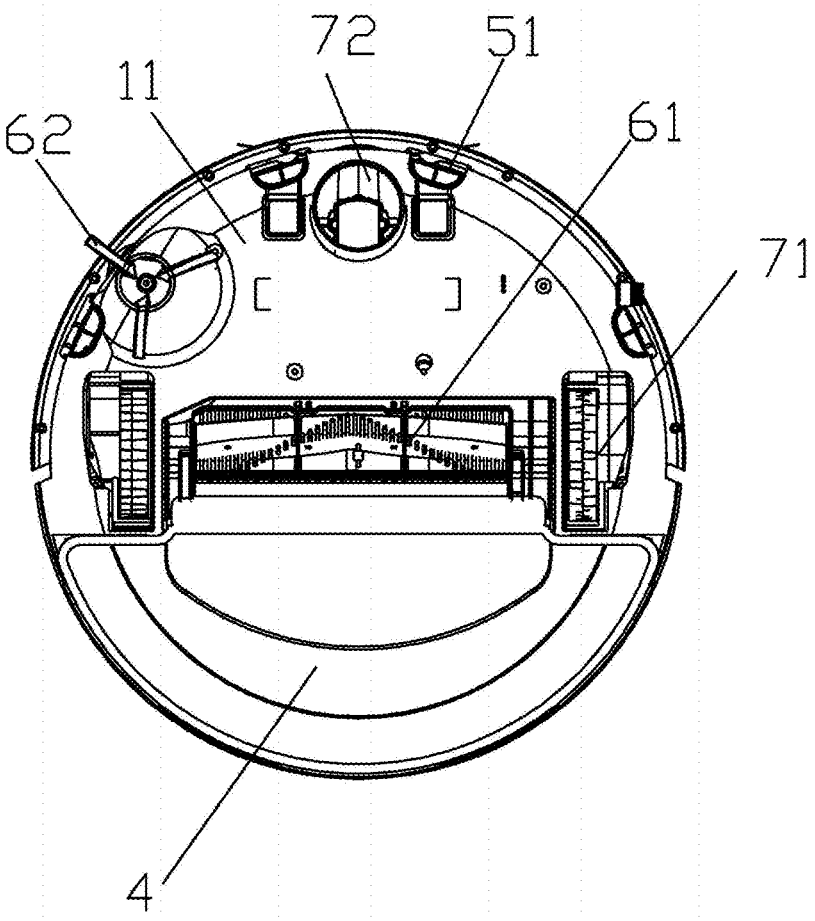
FIG. 2 illustrates a schematic view of a second view of an autonomous cleaning robot, in accordance with embodiments of the present disclosure.

As shown in FIGS. 1 and 2, the autonomous cleaning robot may be, but is not limited to, a smart sweeping robot, a solar panel robot or a building exterior cleaning robot. The embodiments of the present disclosure will be described with reference to a smart sweeping robot.

The autonomous cleaning robot may include, in addition to the main body 1 and the cleaning assembly, a sensing system, a control system (not shown), a drive system, an energy system and a human-computer interaction system 9. The main parts of the intelligent cleaning robot will be described in detail below.

The main body 1 may include an upper cover, a forward portion 13, a backward part 14, a chassis 11, and so on. The main body 1 has an approximately circular shape (rounded both before and after), and may have other shapes, including but not limited to an approximately D-shaped form with a front square and a rear circle.

The sensing system includes a position-determining device located above the main body 1, a buffer located at the forward portion 13 of the main body 1, a cliff sensor 51 and an ultrasonic sensor, infrared sensor, magnetometer, accelerometer, gyroscope, odometer and other sensing devices. These sensing devices provide the control system with various location information and motion-status information for the machine. The position-determining device includes, but is not limited to, an infrared transmitting and receiving device, a camera, and a laser distance-measuring device (LDS).

The cleaning assembly may include a dry-cleaning section and a wet-cleaning section. Wherein, the wet-cleaning section is the first cleaning subassembly 2. The wet-cleaning section is configured to wipe the surface (such as the ground) by the cleaning cloth 4 containing the cleaning liquid. The dry-cleaning section is a second cleaning subassembly. The dry-cleaning section is configured to clean the fixed-particle contaminants on the cleaned surface by the cleaning brush and other structures.

The main cleaning function of the dry-cleaning section is derived from the second cleaning section, including a roller brush 61, the dust cartridge, the fan, the air outlet, and the connecting member therebetween. The roller brush 61 has a certain interference with the ground, sweeps dusts on the ground and rolls it in front of the suction port between the roller brush 61 and the dust cartridge. Then the dusts are sucked into the dust cartridge by the suction gas generated by the fan and through the dust cartridge. The dust-removal capacity of the sweeping machine can be characterized by the dust pick-up efficiency (DPU). The DPU is influenced by the structure and material of the roller brush 61, and also by the wind-utilization efficiency of a duct formed by the suction ports, the dust cartridge, the fan, the air outlet and the connecting member therebetween, as well as by the type and power of the fan. Compared to ordinary plug-in vacuum cleaners, the improvement of dust-removal capacity is more meaningful for cleaning robots with limited energy resources. The improvement of dust-removal capacity directly and effectively reduces the energy requirements. In other words, the robot could clean the 80-square-meter ground previously in case of one charge, and now the robot can evolve into cleaning 100 square meters or more in case of one charge. Reducing the number of charges makes the battery life greatly increase and makes the frequency at which the user changes the battery decrease More intuitive and important, the improvement of dust-removal capacity is the most obvious and important user experience. The user will directly find out whether the cleaning and wiping are sufficient. The dry-cleaning system may also include a side brush 62 having a rotary shaft. The rotary shaft is at an angle relative to the ground. The rotary shaft is configured to move the debris into the cleaning area of the roller brush 61 of the second cleaning section.

As the wet-cleaning section, the first cleaning subassembly 2 may mainly include the liquid container 3 mentioned above and a cleaning cloth 4, etc. The liquid container 3 serves as a base for supporting other components of the first cleaning subassembly 2. The cleaning cloth 4 is removable and mounted on the liquid container 3. The cleaning cloth 4 wipes the ground after the ground is cleaned by the roller brush and the like.

The drive system is configured to drive the main body 1 and components mounted on the main body to move for automatic travel and cleaning. The drive system may include a drive-wheel module 71. The drive system can issue a drive command to manipulate the robot to travel across the ground based on distance information and angle information, such as the x, y and theta components. The drive-wheel module 71 can simultaneously control the left wheel and the right wheel. In order to more precisely control the movement of the machine, it is preferable that the drive-wheel module 71 include a left drive-wheel module and a right drive-wheel module. The left and right drive-wheel modules are opposed (symmetrically) along the lateral axis defined by the main body 1. The robot may include one or more driven wheels 72. The driven wheels include, but are not limited to, a caster so that the robot can move more stably or stronger on the ground.

The drive-wheel module 71 may include a travel wheel, a drive motor and a control circuit for controlling the drive motor. The drive-wheel module 71 may also be connected to a circuit for measuring the drive current and an odometer. The drive-wheel module 71 is detachably connected to the main body 1 for easy disassembly and maintenance. The drive wheel may have an offset drop-suspension system that is movably fastened, for example, and rotatably attached to the main body 1, and receives a spring offset biased downwardly and away from the main body 1. The spring offset allows the drive wheel to maintain contact and traction with the ground with a certain ground force. At the same time, the robot's cleaning elements (such as the roller brush, etc.) also contact the ground with a certain pressure.

The forward portion 13 of the main body 1 may carry a buffer. When the drive-wheel module 71 drives the robot to travel on the ground during cleaning, the buffer detects one or more events in the travel path of the robot via a sensor system such as an infrared sensor. The robot may control the drive-wheel module 71 to respond to the events detected by the buffer to, for example, run away from obstacles. The events may include meeting an obstacle or a wall, etc.

The control system is provided on the circuit board in the main body 1. The control system may include a temporary memory and a communication-computing processor. The temporary memory may include a hard disk, a flash memory and a random-access memory. The communication-computing processor may include a central processing unit and an application processor. The application processor can draw an instant map of the environment in which the robot is located based on the obstacle information fed back by the LDS and the positioning algorithm, such as SLAM.

The distance information and velocity information fed back by the sensor, such as the buffer, the cliff sensor 51, the ultrasonic sensor, the infrared sensor, the magnetometer, the accelerometer, the gyroscope, the odometer, and so on, are used to determine the current working state of the sweeping machine. The working state of the sweeping machine may include crossing the threshold, walking on the carpet, at the cliff, above or below stuck, the dust cartridge full, or picked up, etc. The application processor gives specific instructions for the next step for different situations. The robot is more in line with the requirements of the owner and provides a better user experience. Furthermore, the control system can plan the most efficient cleaning path and cleaning method based on real-time map information drawn by SLAM, which greatly improves the cleaning efficiency of the robot.

The energy system may include a rechargeable battery such as a nickel-metal hydride battery and a lithium battery. The rechargeable battery can be coupled to a charging control circuit; a battery pack-charging, temperature-detecting circuit; and a battery-under-voltage monitoring circuit. The charging control circuit, the battery pack-charging, temperature-detecting circuit, and the battery-under-voltage monitoring circuit are connected with the microcontroller control circuit. The host is charged by connecting to the charging pile provided on the side or the lower side of the host. If the exposed charging electrode is dusted, the plastic body around the electrode will melt and deform due to the accumulation of charge during the charging process and even cause the electrode itself to be deformed and unable to continue to be charged normally.

The human-computer interaction system 9 includes buttons on the host panel, and buttons are configured to select the function for the user. The human-computer interaction system may also include a display screen and/or a light, and/or a speaker, and the display, the light and the speaker are configured to show the user the status of the machine or a function selection. The human-computer interaction system may also include a mobile client application. For the path navigation-type cleaning equipment, the mobile client can show the user the map of the equipment located, as well as the location of the equipment, and can provide users with more rich and user-friendly features.

In order to describe the behavior of the autonomous cleaning robot more clearly, directions are defined as follows. The autonomous cleaning robot can travel on the ground by various combinations of movements of the following three mutually perpendicular axes defined by the main body 1: a front and rear axis X (i.e., the axis in the direction of the forward part 13 and the backward part 14 of the main body 1), a lateral axis Y (i.e., the axis perpendicular to the axis X and the same horizontal as the axis X) and a center vertical axis Z (axis perpendicular to axis X and axis of axis Y). The forward direction of the front and rear axis X is defined as "forward," and the backward direction of the front and rear axis X is defined as "backward." The lateral axis Y extends along the axis defined by the center point of the drive-wheel module 71 between the right wheel and the left wheel of the autonomous cleaning robot.

The autonomous cleaning robot can rotate around the Y axis. When the forward part of the autonomous cleaning robot is tilted upward and the backward part is tilted downward, it is defined as "up." When the forward part of the robot is tilted downward and the backward part is tilted upward, it is defined as "down." In addition, the robot can rotate around the Z axis. In the forward direction of the robot, when the robot tilts to the right side of the X axis, it is defined as "right turn," and, when the robot tilts to the left side of the X axis, it is defined as "left turn."

The dust cartridge is mounted in a receiving chamber by means of buckle and handle. When the handle is pulled, the buckle shrinks. When the handle is released, the buckle extends to a groove of the receiving chamber.

The specific structure of the first cleaning subassembly 2 and the main body 1 will be described in detail below.

The first cleaning subassembly 2 is mounted on the main body 1 by a guiding member, and the first cleaning subassembly 2 is movable up and down with respect to the main body 1. That is, a gap exists between the first cleaning subassembly 2 and the main body 1.

In some embodiments, the first cleaning subassembly 2 is mounted on the chassis 11 of the main body 1. The chassis 11 is provided with a protrusion structure 113 for mounting the first cleaning subassembly 2. In the embodiments of the present disclosure, the first cleaning subassembly 2 is mounted on the chassis 11 at the backward part 14 of the main body 1.

The first cleaning subassembly 2 is mounted to the chassis 11 through a guiding member, and the first cleaning subassembly 2 is in clearance fit with the chassis 11.

As shown in FIGS. 3 to 10, the guiding member may include a first guide ridge 311 and a first guiding groove 111. The first guiding groove 111 is defined on one of the first cleaning subassembly 2 and the chassis 11. The first guide ridge 311 is mounted on the other of the first cleaning subassembly 2 and the chassis 11.

Figure 11:
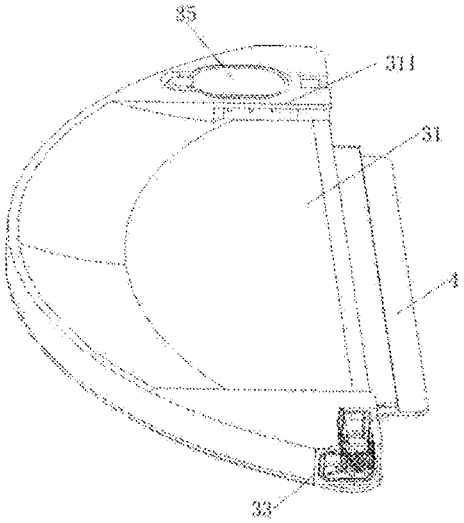
FIG. 11 illustrates a schematic view of a first view of a liquid container of an autonomous cleaning robot, in accordance with embodiments of the present disclosure.
Figure 12:
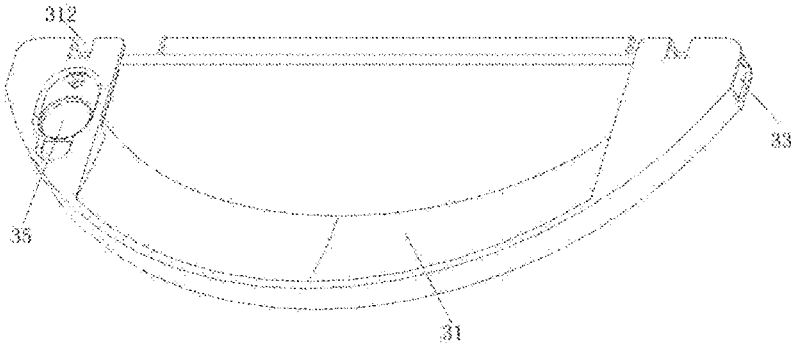
FIG. 12 illustrates a schematic view of a second view of a liquid container of the autonomous cleaning robot, in accordance with embodiments of the present disclosure.

In the embodiments of the present disclosure, the first guiding groove 111 is mounted on the side wall of the protrusion structure 113 of the chassis 11. The first guide ridge 311 is mounted on the liquid container 3 of the first cleaning subassembly 2. When the liquid container 3 is engaged with the chassis 11, the first guide ridge 311 inserts into the first guiding groove 111 to realize the guiding and stop action. As shown in FIG. 11, in order to avoid the protrusion structure 113 on the chassis 11, the liquid container 3 defines a recess thereon.

Preferably, in order to facilitate the installation of the liquid container 3, the thickness of the first guide ridge 311 is smaller than the width of the first guiding groove 111 (the width of the first guiding groove 111 refers to the width between the opposite-side walls of the first guiding groove 111, i.e., the vertical distance between the two opposite-side walls when the robot is in the horizontal position). After the first guiding ridge 311 is inserted into the first guiding groove 111, the first guiding ridge 311 has a distance between the opposite-side walls of the first guiding groove 111. A clearance-fit structure between the liquid container 3 and the chassis 11 is formed to facilitate the user to install the liquid container 3.

The width of the gap between the liquid container 3 and the chassis 11 can be determined as desired. In the embodiments of the present disclosure, the width of the gap between the liquid container 3 and the chassis 11 is in the range of 1.5 mm to 4 mm. In some embodiments, the gap between the liquid container 3 and the chassis 11 is 2 mm. The gap provides a space for the insertion action when the user inserts the liquid container 3 into the chassis 11 without overturning the robot. The user can smoothly mount the liquid container 3 to the chassis 11, but it is not required to strictly align the liquid container 3 with the chassis 11. The current mopping robot usually needs to be overturned (i.e., bottom up) by the user, and then the tank can be installed. On the one hand, it is inconvenient for the user to use and install; on the other hand, if the tank leaks, the water easily leaks into the interior of the robot, causing the robot to be damaged.

In the embodiments of the present disclosure, the first cleaning subassembly 2 is mounted to the main body 1 in the forward direction or the backward direction of the main body 1 and then connected to the main body 1 through a connecting member. The connecting member may include a first connecting member provided on the main body 1 and a second connecting member provided on the first cleaning subassembly 2.

In some embodiments, in order to facilitate control of the connection and separation of the first cleaning subassembly 2 from the main body 1, an autonomous cleaning robot may further include a connection-control assembly. The connection-control assembly is connected to the first connecting member or the second connecting member and controls the connection and separation of the second connecting member and the first connecting member.

Preferably, the connection-control assembly is mounted on the first cleaning subassembly 2.

In the embodiments of the present disclosure, the connection structure is a buckle structure and the liquid container 3 is connected to the chassis 11 through a catching structure. The connection is not only easy to install, but also reliable. Of course, in other embodiments, the connection structure may be other structures, such as a magnetic absorbing structure, and the liquid container 3 may be connected to the chassis 11 by other means such as magnetic stripping. Correspondingly, the connection-control assembly can be a card-control system or can also be a magnetic suction-control system to ensure that users can easily install and remove it.

In some embodiments, the connecting member is a buckle structure. The liquid container 3 is connected to the chassis 11 through the buckle structure. The buckle structure is not only easy to be installed, but also reliable. Of course, in other embodiments, the connecting member may be other structures, such as a magnetic structure. The liquid container 3 may be connected to the chassis 11 by other means, such as magnetic connection. Correspondingly, the connection-control assembly may be a catching-control system or a magnetic-control system to ensure that users can easily install and remove it.

The features will be described in detail with respect to the specific embodiment in which the liquid container 3 and the chassis 11 are connected by a buckle structure.

Figure 7:
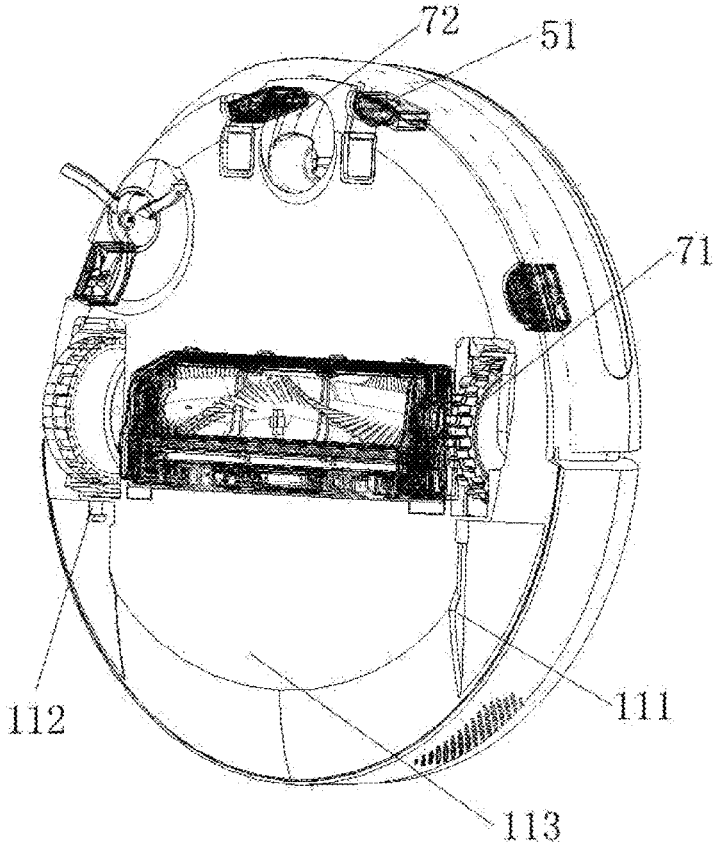
FIG. 7 illustrates a bottom schematic view of a main body of an autonomous cleaning robot, in accordance with embodiments of the present disclosure.
Figure 8:
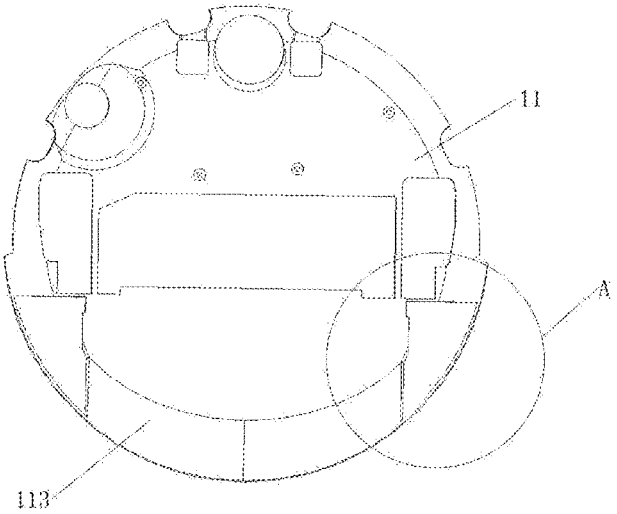
FIG. 8 illustrates a bottom view of a chassis of a main body of an autonomous cleaning robot, in accordance with embodiments of the present disclosure.
Figure 9:
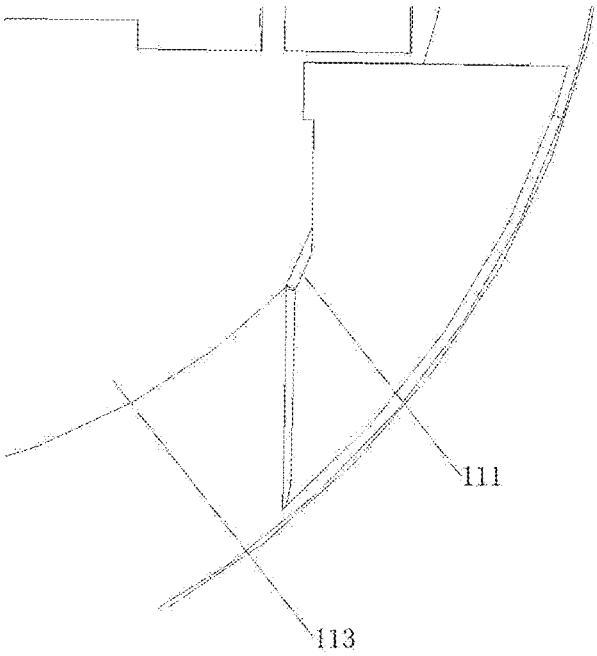
FIG. 9 is a partial enlarged view of A in FIG. 8.
Figure 10:
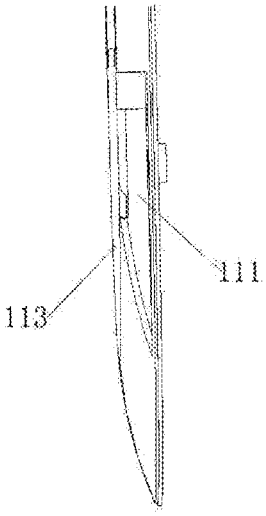
FIG. 10 illustrates a side view of a first guiding groove on the chassis of the main body of an autonomous cleaning robot, in accordance with embodiments of the present disclosure.
Figure 18:
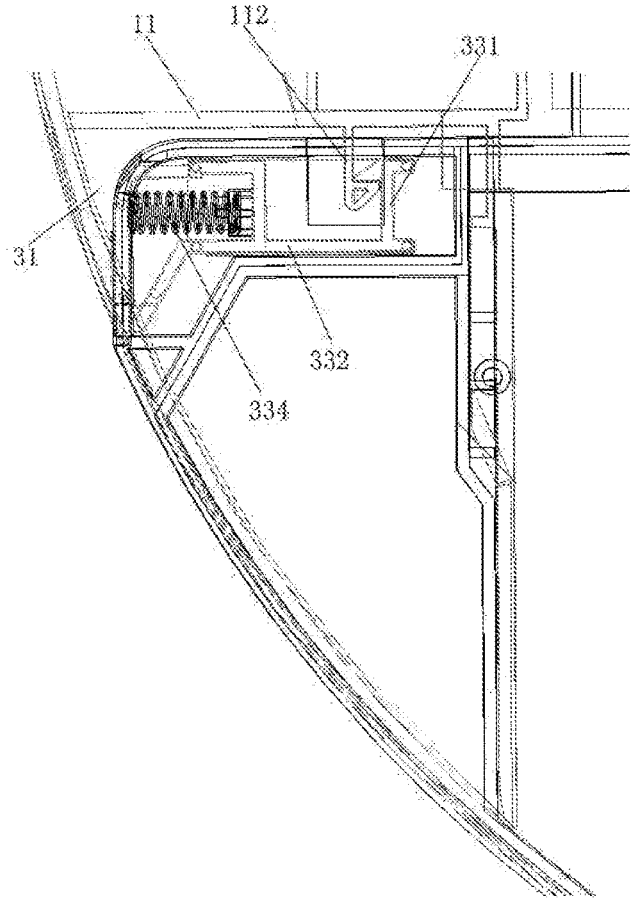
FIG. 18 illustrates a schematic view of the structure of the engagement-control member, the first-buckle and the second-buckle fit of the autonomous cleaning robot, in accordance with embodiments of the present disclosure.

Referring to FIG. 7, the chassis 11 is provided with a first connecting member. The first connecting member may be a first buckle 112 or an electromagnet or a magnetic conductor, and so on. Taking the first buckle as an example, the first buckle 112 is configured to couple with the liquid container 3 to realize the fixing of the liquid container 3. Referring to FIGS. 11 to 17, the liquid container 3 is provided with the second connecting member. The connecting member may be a second buckle 331 cooperated with the first buckle 112 or an electromagnet or a magnetic conductor. The first buckle 112 and the second buckle 331 cooperatively constitute the connecting member. The second buckle 331 defines a stop position and a retracting position. As shown in FIG. 18, at the stop position, the second buckle 331 and the first buckle 112 are stopped from each other and the liquid container 3 is connected to the chassis 11. At the retracting position, the second buckle 331 is separated from the first buckle 112 and the liquid container 3 can be detached from the chassis 11.

In order to control the engagement and separation of the first buckle 112 and the second buckle 331, the connection-control assembly may include an engagement-control member 33. The engagement-control member 33 controls the position of the second buckle 331 to make the second buckle engaged with or separated from the first buckle 112. In use, the user can control the engagement-control member 33 to control the position of the second buckle 331. That is, the liquid container 3 and the chassis 11 may be engaged or separated to facilitate the loading or removal of the liquid container 3.

In some embodiments, an upper cover 31 of the liquid container 3 defines a groove for mounting the engagement-control member 33 and the second buckle 331. The engagement-control member 33 is provided in the upper cover 31. The upper cover 31 defines an opening for the first connecting member inserting thereinto and the first connecting member cooperating with the second connecting member.

Further, the liquid container 3 includes a container case, and the container case consists of an upper cover 31 and a lower cover 32. The container case includes a liquid accommodation space. In the embodiments of the present disclosure, the liquid placed in the liquid container 3 is water. Of course, in other embodiments, any other cleaning solution may be placed in the liquid container 3 as necessary.

Additionally, the liquid container 3 includes the container case, the upper cover 31, and the lower cover 32. The container case defines a liquid accommodating room. In the embodiments, the liquid placed in the liquid container is water. Of course, in other embodiments, the liquid container may contain any other cleaning solution as required.

As illustrated in FIGS. 14 to 17, one of the engagement-control assemblies may include a mounting frame 332, an operating member 333 and an elastic member 334.

The second buckle 331 is fixedly mounted on the mounting frame 332, which is movably provided in the container case and which drives the second buckle 331 to move to the stop position or the avoidance position. The operating member 333 is mounted on the mounting frame 332 and integrally with the mounting frame 332. When the user presses the operating member 333, the operating member 333 drives the mounting frame 332 and the second buckle 331 thereon to move together.

The second buckle 331 is fixedly mounted on the mounting frame. The mounting frame is movably disposed within the container case and can drive the second buckle 331 to the stop position or retracting position. The operating member is mounted on the mounting frame and is integrally formed with the mounting frame 332. When the user presses the operating member 333, the operating member 333 drives the mounting frame 332 and the second buckle 331 thereon to move together.

The elastic member 334 is provided between the operating member 333 and the container case of the liquid container 3 to ensure that the second buckle 331 can be returned to the stop position after the pressing force is lost, thereby ensuring that the liquid container 3 can connect with the chassis 11 reliably. The elastic member 334 may be a structure that can provide an elastic force such as a spring, an elastic rubber or the like. A first end of the elastic member 334 abuts against the operating member 333 or the mounting frame 332. The second end of the elastic member 334 abuts against the container case. And the direction of expansion and contraction of the elastic member coincides with the moving direction of the mounting frame. In the condition of no press, the elastic force of the elastic member 334 causes the second buckle 331 to be held in the stop position. When the user needs to remove the liquid container 3, the user presses the operating member 333 to move the second buckle 331 to the retracting position; the first buckle 112 and the second buckle 331 on the chassis 11 are separated from the stopper, and then the liquid container 3 can be successfully removed.

Figure 13:
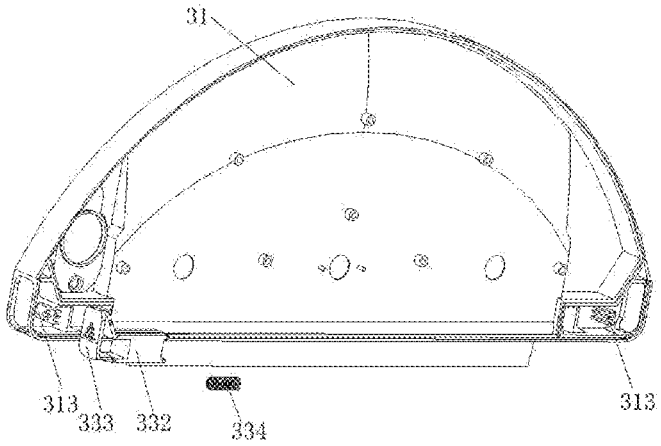
FIG. 13 illustrates a schematic view of a first view of an upper cover and an engagement-control subassembly of a liquid container of an autonomous cleaning robot, in accordance with embodiments of the present disclosure.
Figure 14:
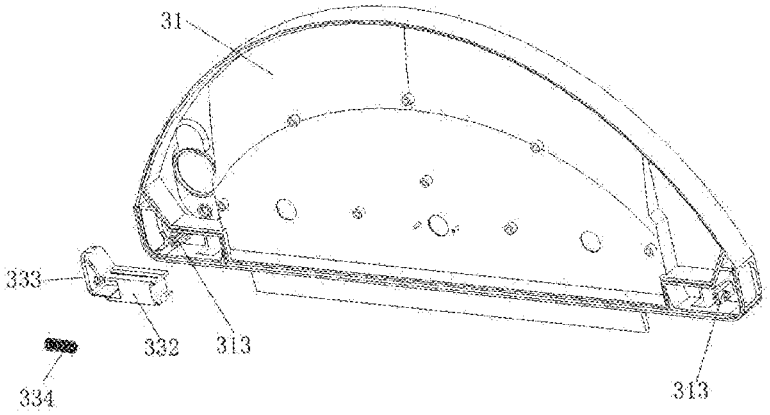
FIG. 14 illustrates an explosion view of a second view of an upper cover and an engagement-control subassembly of a liquid container of an autonomous cleaning robot, in accordance with embodiments of the present disclosure.
Figure 15:
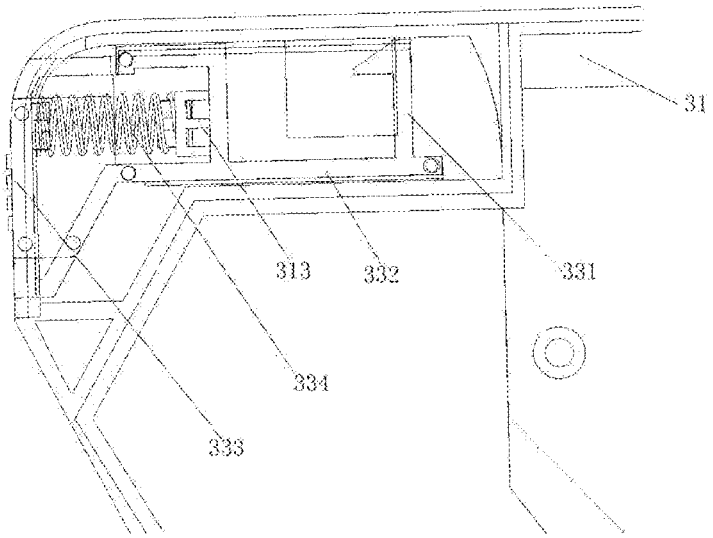
FIG. 15 illustrates a schematic view of the upper cover and the engagement-control subassembly fit of a liquid container of an autonomous cleaning robot, in accordance with embodiments of the present disclosure.
Figure 16:
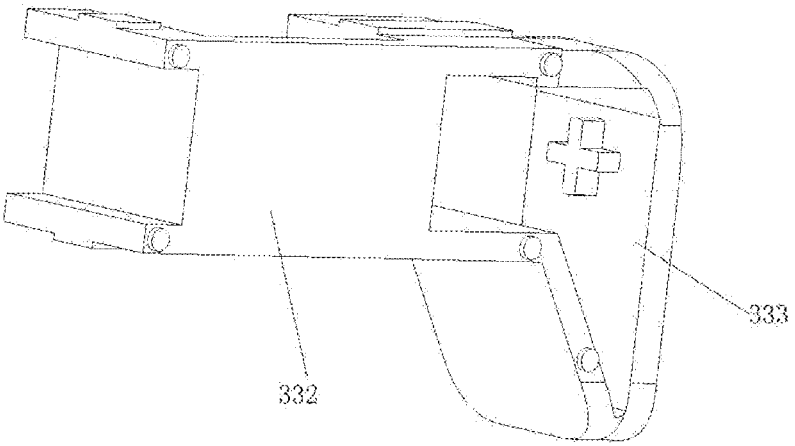
FIG. 16 illustrates a schematic view of a first view of a mounting frame of an engagement-control subassembly of an autonomous cleaning robot, in accordance with embodiments of the present disclosure.
Figure 17:
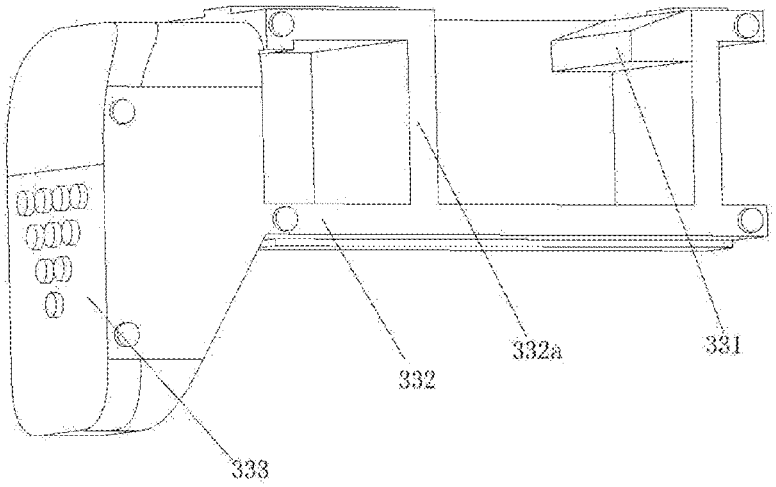
FIG. 17 illustrates a schematic view of a second view of a mounting frame of an engagement-control subassembly of an autonomous cleaning robot, in accordance with embodiments of the present disclosure.

Referring to FIG. 13, in order to facilitate the restriction of the mounting frame 332, the mounting frame 332 is released from the liquid container 3 without the pressing force due to the elastic force of the elastic member 334. A stopper projection 313 is mounted on the container case of the liquid container, the mounting frame 332 is provided with a hole for extending the stopper projection 313, and the stroke of the mounting frame 332 can be defined by fitting the stopper projection 313 and the hole wall 332*a* of the hole.

As illustrated in FIG. 13, a stop protrusion 313 is provided on the container case of the liquid container. The mounting frame 332 defines a hole for the protrusion extending in. The stroke of the mounting frame 332 can be defined by fitting the stopper projection 313 and the hole wall 332*a* of the hole. Thus, the mounting frame 332 can be limited, and the mounting member 332 can be released from the liquid container 3 without the pressing force due to the elastic force of the elastic member 334.

In the embodiments of the present disclosure, the first end of the elastic member 334 abuts against the operating member 333 and the second end abuts against the stopper projection 313. The operating member 333 and the stopper projection 313 are both provided with a cross-convex post for mounting the elastic member 334.

Figure 3:
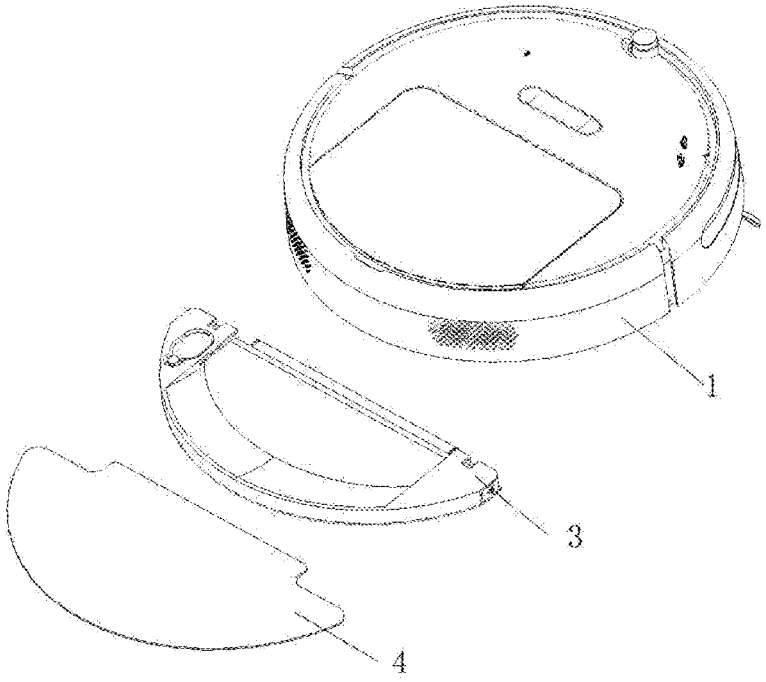
FIG. 3 illustrates a schematic view of a first perspective view of a main body and a first cleaning subassembly of an autonomous cleaning robot, in accordance with embodiments of the present disclosure.
Figure 4:
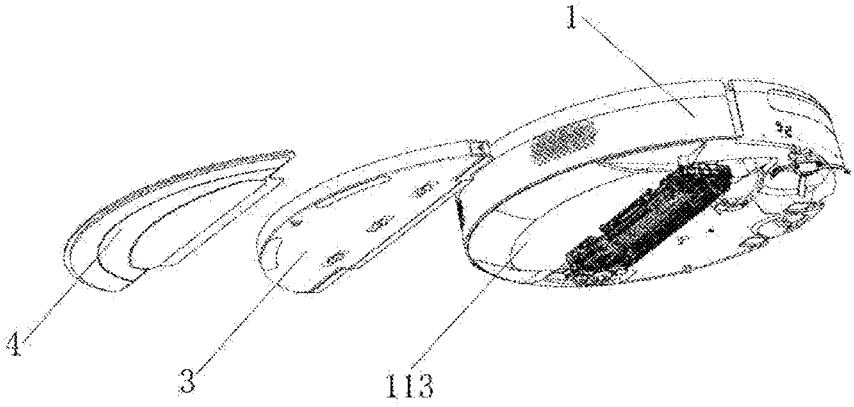
FIG. 4 illustrates a schematic view of a second view of a main body and a first cleaning subassembly of an autonomous cleaning robot, in accordance with embodiments of the present disclosure.
Figure 5:
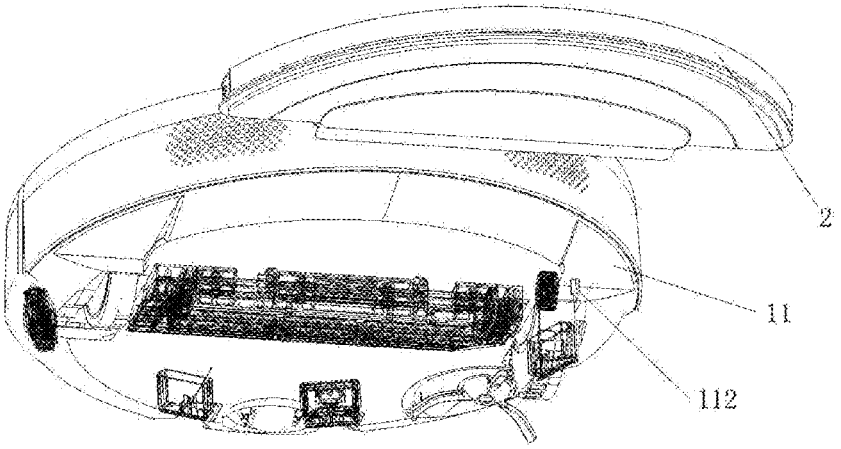
FIG. 5 illustrates a schematic view of a third view of a main body and a first cleaning subassembly of an autonomous cleaning robot, in accordance with embodiments of the present disclosure.
Figure 6:
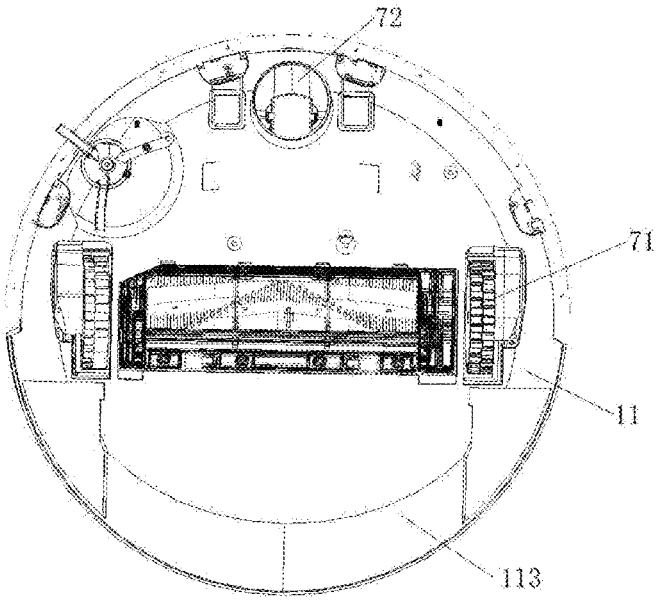
FIG. 6 illustrates a bottom view of a main body of an autonomous cleaning robot, in accordance with embodiments of the present disclosure.

The specific process of loading the liquid container 3 into the chassis 11 is as follows:

As illustrated in FIGS. 3 and 4, the liquid container 3 is inserted into the rear portion of the chassis 11 along the first guiding groove 111 on the chassis 11 to form an overall appearance of the autonomous cleaning robot. The chassis 11 of the robot has a first connecting portion. In some specific embodiments, the first connection may be a hook. The hook can connect with a second connection portion of the liquid container. In some specific embodiments, the second connection portion may be a buckle so that the liquid container can be fixed to the bottom of the main body 1. The first guiding groove 111 may be a U-shaped groove and can be slid with the first guiding ridge 311 on the liquid container to guide the liquid container 3 to slide on the chassis 11.

In the natural state, the second buckle 331 is in the groove of the liquid container 3. When the liquid container 3 is slid into the mating position along the first guiding groove 111 on the chassis 11, the first buckle 112 (hook) on the chassis 11 abuts against the second buckle 331 so that the second buckle 331 moves toward a region other than the groove. The first buckle 112 (hook) can slide into the groove along the slope on the second buckle 331 when the force is applied to a certain extent. Then the second buckle 331 is engaged with the first buckle 112 (hook) so that the liquid container 3 is fixed on the chassis 11. After the liquid container 3 is mounted on the chassis 11, when the fix needs to be released, the operating member 333 of the engagement-control member 33 can be pressed by overcoming the spring resistance. The second buckle 331 may be retracted in the liquid container 3 by the force transmission. Then the engagement between the first buckle 112 (hook) and the second buckle 331 may disappear, and the liquid container can be pulled out from the backward direction of main body 1 to realize the unloading of the liquid container 3.

Figure 19:
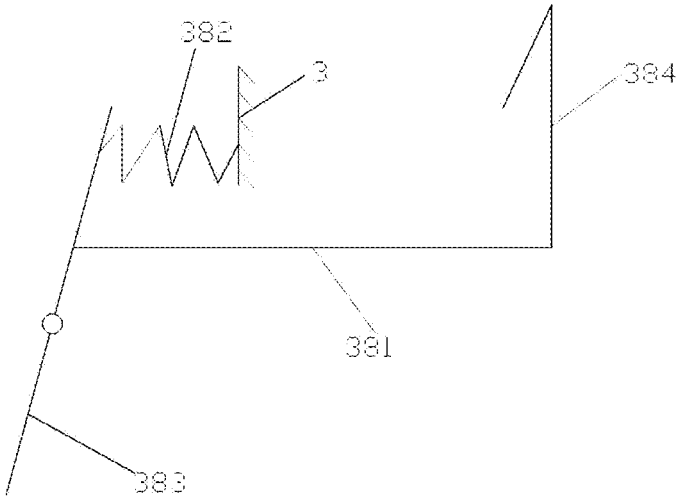
FIG. 19 illustrates a schematic view of another engagement-control subassembly of an autonomous cleaning robot, in accordance with embodiments of the present disclosure.
Figure 20:
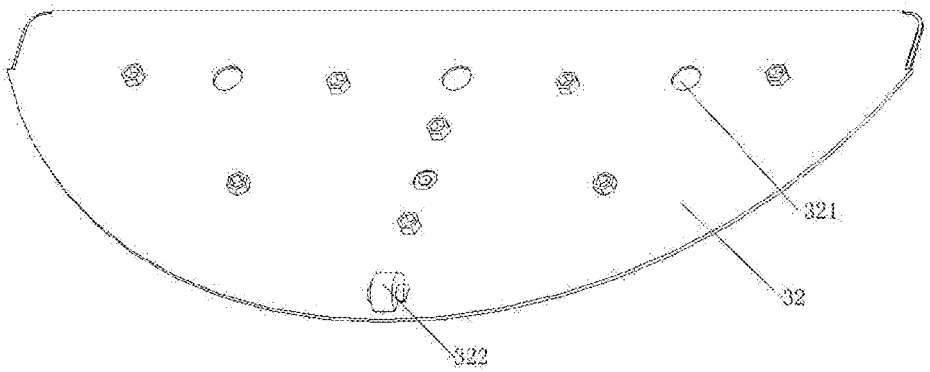
FIG. 20 illustrates a schematic view of a first view of a lower cover of a liquid container of an autonomous cleaning robot, in accordance with embodiments of the present disclosure.
Figure 21:
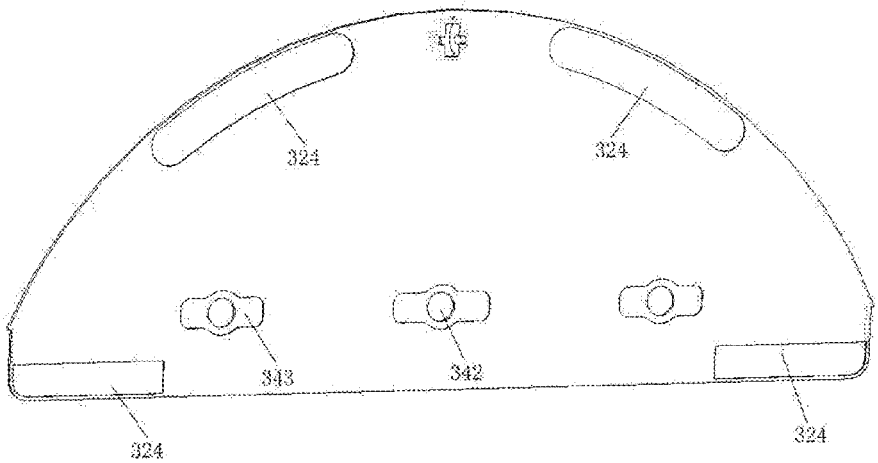
FIG. 21 illustrates a schematic view of a second view of a lower cover of a liquid container of an autonomous cleaning robot, in accordance with embodiments of the present disclosure.
Figure 22:
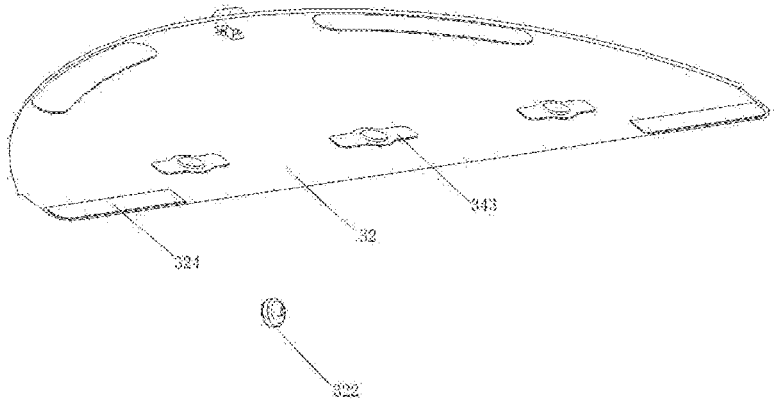
FIG. 22 illustrates a schematic view of a third view of a lower cover of a liquid container of an autonomous cleaning robot, in accordance with embodiments of the present disclosure.
Figure 23:
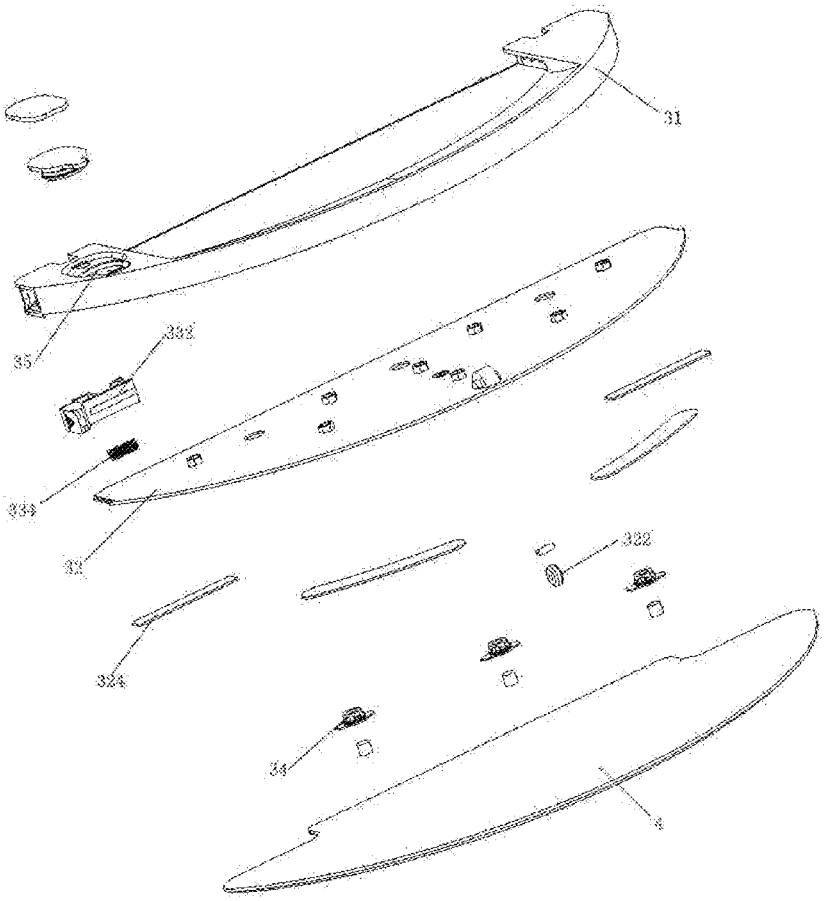
FIG. 23 illustrates a schematic view of a liquid container of an autonomous cleaning robot, in accordance with embodiments of the present disclosure.

In another engagement-control assembly (not shown), the engagement-control assembly includes a connecting rod 381, a spring 382, a toggle piece 383 and a buckle 384. The buckle 384 is configured to cooperate with the first buckle 112 to effect connection of the liquid container 3 and the chassis 11. The connecting rod 381 is provided in the liquid container 3. The first end of the connecting rod 381 is provided with the buckle 384, and the second end of the connecting rod 381 is provided with a toggle piece 383. The toggle piece 383 is rotatable as provided in the liquid container 3. A first end of the toggle piece 383 is connected with a spring 382, and a second end of the toggle piece 383 is an operating end. The spring 382 is connected between the toggle piece 383 and the liquid container 3. The schematic view of the engagement-control member is shown in FIG. 19.

As shown in FIGS. 20 to 23, the upper cover 31 of the liquid container 3 is further provided with a water injection port 35 for injecting liquid into the liquid-containing space. The water injection port 35 is provided with a water injection plug and a water injection cap to seal the water injection port 35.

The lower cover 32 of the liquid container 3 is also provided with a water outlet 321, the water outlet 321 communicates with the liquid-accommodation space, and the outlet 321 is removable and provided with a water outlet filter 34 for controlling the amount of water.

On the one hand, the lower cover 32 cooperates with the upper cover 31 to form the container case and surrounds the liquid-accommodating room for accommodating the liquid. On the other hand, the lower cover is configured to mount the cleaning cloth 4. A plurality of adhesive structures 324 are fixed to one side of the lower cover 32 remotely from the upper cover 31. The cleaning cloth 4 is laid on the side of the lower cover 32, far away from the upper cover 31, and is attached to the lower cover 32 by the adhesive structure 324. The adhesive structure 324 may be a double-sided adhesive or a Velcro. In order to facilitate the replacement of the cleaning cloth 4, preferably the adhesive structure 324 is a Velcro.

The liquid in the liquid-accommodating space flows out of the water outlet 321 on the lower cover 32 and wets the cleaning cloth 4.

In the embodiments of the present disclosure, the control of the amount of water discharged from the water outlet 321 is controlled by the filter structure provided in the water outlet 321. Compared with a water-seepage cloth arranged in the water tank, with one end arranged in the water storage space and the other end arranged at the outlet, guiding the water in the water tank to the outlet through capillary action, using the filter structure to control the water discharged, can solve the problem of the water flow rate that is not easy to control with the water-seepage cloth. Because the water-seepage cloth needs to be completely set in the container case body, the replacement of the water-seepage cloth is inconvenient and costly, and the water tank is required to be disassembled. The filter structure is removable as provided in the outlet 321 for easier replacement. By selecting a filter structure with different material, the amount of the water discharged can be controlled and the needs of users can be better met.

Figure 24:
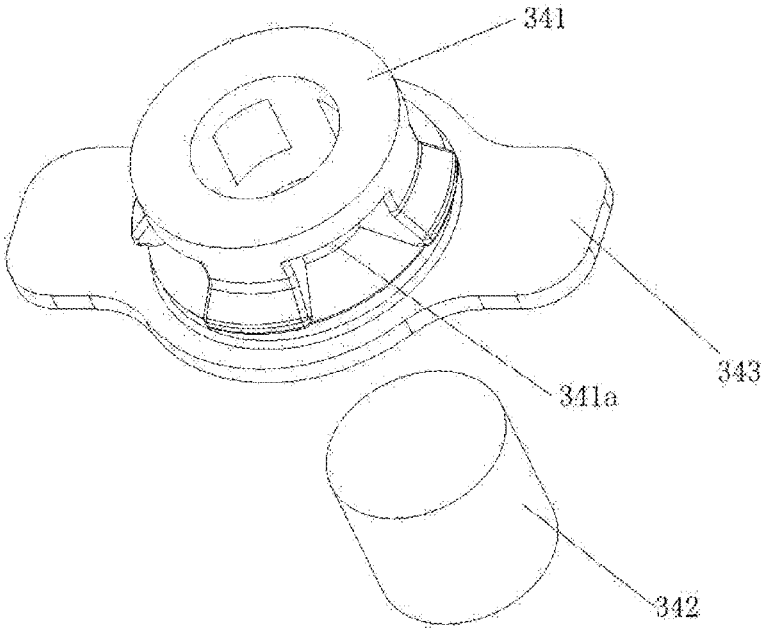
FIG. 24 illustrates a schematic view of a first view of a water outlet filter of an autonomous cleaning robot, in accordance with embodiments of the present disclosure.
Figure 25:
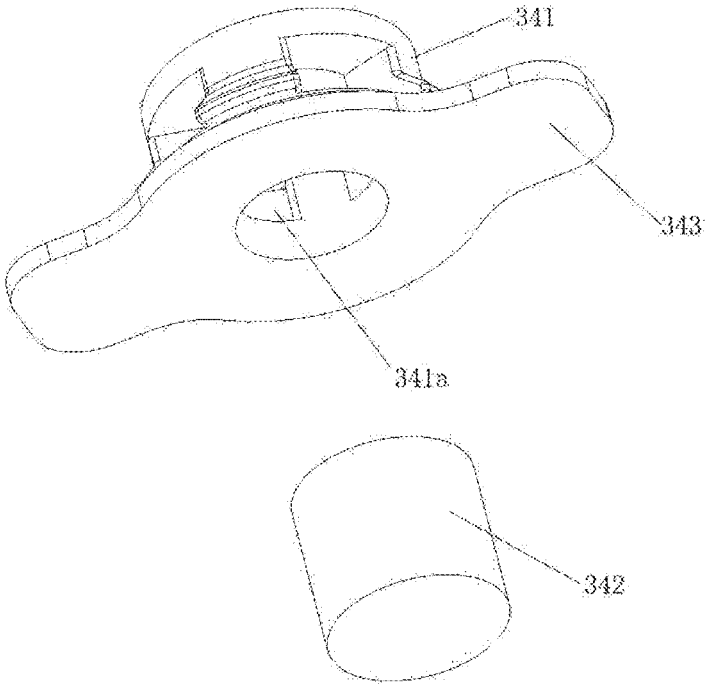
FIG. 25 illustrates a schematic view of a second view of a water outlet filter of an autonomous cleaning robot, in accordance with embodiments of the present disclosure.

In the embodiments of the present disclosure, the filter structure is the water outlet filter 34. As shown in FIGS. 24 and 25, the water outlet filter 34 may include a filter mounting frame 341 and a filter core 342. The filter mounting frame 341 is detachably mounted in the water outlet 321 of the lower cover 32. The mounting frame 341 defines a receiving hole therein for accommodating the filter core 342, and the filter core 342 is filled in the receiving hole. The filter mounting frame 341 further defines an inlet hole 341*a* to communicate with the receiving hole and the liquid-accommodation space.

After the filter mounting frame 341 is mounted on the water outlet 321 of the lower cover 32, the amount of water can be controlled by the filter core 342. Since the filter mounting frame 341 is inserted into the water outlet 321 from the outside of the lower cover 32 (the side away from the upper cover 31), the water outlet filter 34 can be replaced without disassembling the container case, so the replacement is more convenient. While the control of the amount of water only needs to select the different permeability of the filter core 342, the water control is more accurate and good, thus ensuring the cleaning effect.

Of course, in other embodiments, the water outlet filter 34 may include only the filter core 342, so long as the water can be controlled.

In some embodiments, the number of the water outlet filters 34 is two or more. Each water outlet filter 34 corresponds to a water outlet 321. The number of the water outlet filters 34 may be appropriately selected depending on the area of the cleaning cloth 4 and the required humidity. More preferably, there are two water outlet filters 34, and the distance between the two is 10 mm to 350 mm to ensure uniform wetting of the cleaning cloth 4. More preferably, the distance between the two water control filters is 80 mm to 90 mm.

In some embodiments, the water outlet filter 34 may further include the stop gasket 343 (which may be made of a rubber material). The stop gasket 343 is fixed to one end of the filter mounting frame 341, far away from the upper cover 31. A side of the lower cover 32, far away from the upper cover 31, defines a recess for receiving the stop gasket 343. On the one hand, the stop gasket 343 can prevent the liquid from flowing out of the gap between the water outlet and the water outlet filter 34, and, on the other hand, an operation position can be provided for easily removing the water outlet filter 34. The water outlet filter 34 is used to control the amount of water discharged, making the replacement more convenient. And, according to the needs in different environments, the filter core 342 with different materials makes the amount of water discharged controllable and is a user-friendly choice.

An obstacle-assisting structure is provided on the bottom of the liquid container 3. The obstacle-assisting structure can assist the drive-wheel module 71 of the autonomous cleaning robot when the autonomous cleaning robot is climbing or stepping and provide support for the autonomous cleaning robot in the liquid container 3 to enhance the climbing and obstacle-surmounting capability thereof.

In some embodiments, the obstacle-assisting structure is an obstacle-assisting wheel for crossing obstacles. The obstacle-assisting wheel 322 is rotatably mounted on the liquid container 3. In some embodiments, the lower cover 32 of the liquid container 3 is provided with the obstacle-assisting wheel 322, and the obstacle-assisting wheel 322 is rotatably mounted on the lower cover 32. The liquid container 3 is located at the end in the backward direction of the liquid container 3. The cleaning cloth 4 defines an opening at the position corresponding to the obstacle-assisting wheel 322 to avoid the obstacle-assisting wheel 322 so that the obstacle-assisting wheel 322 can make contact with the ground when necessary.

Correspondingly, the cleaning cloth is provided with a notch so that the obstacle-assisting wheel 322 can be in contact with the ground. When the autonomous cleaning robot is moved on a horizontal ground, the obstacle-assisting wheel 322 is not in contact with the ground (i.e., when the main body is in the horizontal state, the lowest point of the obstacle-assisting wheel provided on the liquid container is higher than the lowest point of the walking wheel). When the autonomous cleaning robot is tilted on the slope or climbing step, the obstacle-assisting wheel 322 is in contact with the ground to form a sliding support point to prevent the main body 1 from being jammed and achieve obstacle crossing. The height of the climbing step of the autonomous cleaning robot can be determined as needed, such as a height of the climbing step is 17 mm, 19 mm, or higher.

The autonomous cleaning robot of the present disclosure has the following effects:

The connection mode between the liquid container and the main body is the buckle and groove connection. The liquid container is provided with a mounting and connecting structure that can horizontally load the liquid container into the main body without turning the main body upside down. The liquid container can be directly inserted horizontally into the chassis of the autonomous cleaning robot, which greatly facilitates user installation and disassembly.

The connection mode between the liquid container and the main body is the clearance fit. On one hand, the clearance fit between the liquid container and the main body is convenient for the user to install the liquid container and the main body. If the gap is too small, the liquid container can be inserted only when the gap is in precise alignment, which will cause inconvenience for users. If the gap is large enough, the liquid container can be loaded even if the liquid container is inserted at a certain angle. On the other hand, the clearance fit between the liquid container and the main body can improve the robot's ability to obstruct and prevent getting stuck when encountering obstacles. When the autonomous cleaning robot encounters an obstacle, the liquid container can move up or down to cross the obstacle.

The bottom of the liquid container is provided with the obstacle-assisting wheel. The obstacle-assisting wheel protrudes from the cleaning cloth. The obstacle-assisting wheel comes in contact with the ground when crossing the obstacle. Because the liquid container is in clearance fit with the main body and provided with the obstacle-assisting wheel, the ability to cross the obstacle has greatly improved.

The middle of the liquid container is recessed. Both sides of the liquid container may serve not only as water storage departments, but also installation departments, killing two birds with one stone.

The autonomous cleaning robot controls the effluent by way of the water control filter instead of the water-seepage cloth. The water control filter is more convenient to replace, and the effluent can be adjusted.

The obstacle-assisting wheel is mounted on the liquid container directly so that the ability to cross the obstacle of the autonomous cleaning robot has improved.

While the present disclosure has been described in terms of what is presently considered to be the most practical and preferred embodiments, it is to be understood that the present disclosure need not be limited to the disclosed embodiment. On the contrary, it is intended to cover various modifications and similar arrangements included within the spirit and scope of the appended claims, which are to be accorded with the broadest interpretation to encompass all such modifications and similar structures.

What is claimed is:

1. A liquid container of an autonomous cleaning robot, comprising:

a container case, a cleaning cloth that is removable and mounted on the container case, wherein the cleaning cloth comprises a first guiding member disposed thereon, the container case comprises a second guiding member disposed thereon, and the first guiding member and the second guiding member cooperate with each other and define an assembly direction of the cleaning cloth, and wherein the first guiding member comprises a guiding strip, the second guiding member comprises a mounting groove, and the guiding strip is configured to be inserted in and fix the mounting groove to limit the movement of the cleaning cloth relative to the container case.

2. The liquid container as claimed in claim 1, wherein the cleaning cloth comprises a fixing portion on one side thereof, and the first guiding member is mounted on the fixing portion.

3. The liquid container as claimed in claim 2, wherein the cleaning cloth is semicircular, and the fixing portion is on the straight side of the cleaning cloth.

4. The liquid container as claimed in claim 1, wherein the guiding strip is fixed to the cleaning cloth by a connecting section, the mounting groove comprises a notch for avoiding the connecting portion, and the mounting groove has a first end provided with an opening for the guiding strip passing through and a second end provided with a stop structure to stop the guiding strip.

5. The liquid container as claimed in claim 1, further comprising an auxiliary fixing structure fixed on the container case, wherein the cleaning cloth is fixed to the container case by the auxiliary fixing structure.

6. The liquid container as claimed in claim 5, wherein the auxiliary fixing structure comprises an adhesive structure.

7. The liquid container as claimed in claim 1, wherein the cleaning cloth is a semicircular shape, and the cleaning cloth comprises a water-seepage area, a decontamination area and a water-absorption area.

8. An autonomous cleaning robot, comprising:

a main body, and a cleaning assembly mounted on the main body, wherein the cleaning assembly comprises a first cleaning subassembly detachably mounted on the main body, in a case where the first cleaning subassembly is loaded or removed from the main body, the first cleaning subassembly moves in the forward direction or the backward direction of the main body, and the first cleaning subassembly comprises a liquid container, and wherein the liquid container comprises a container case, a cleaning cloth that is removable and mounted on the container case, wherein the cleaning cloth comprises a first guiding member disposed thereon, the container case comprises a second guiding member disposed thereon, and the first guiding member and the second guiding member cooperate with each other and define an assembly direction of the cleaning cloth, and wherein the first guiding member comprises a guiding strip, the second guiding member comprises a mounting groove, and the guiding strip is configured to be inserted in and fix the mounting groove to limit the movement of the cleaning cloth relative to the container case.

9. The autonomous cleaning robot as claimed in claim 8, wherein the cleaning cloth comprises a fixing portion on one side thereof, and the first guiding member is mounted on the fixing portion.

10. The autonomous cleaning robot as claimed in claim 9, wherein the cleaning cloth is semicircular, and the fixing portion is on the straight side of the cleaning cloth.

11. The autonomous cleaning robot as claimed in claim 8, wherein the guiding strip is fixed to the cleaning cloth by a connecting section, the mounting groove comprises a notch for avoiding the connecting portion, and the mounting groove has a first end provided with an opening for the guiding strip passing through and a second end provided with a stop structure to stop the guiding strip.

12. The autonomous cleaning robot as claimed in claim 8, further comprising an auxiliary fixing structure fixed on the container case, wherein the cleaning cloth is fixed to the container case by the auxiliary fixing structure.

13. The autonomous cleaning robot as claimed in claim 12, wherein the auxiliary fixing structure comprises an adhesive structure.

14. The autonomous cleaning robot as claimed in claim 8, wherein the cleaning cloth is a semicircular shape, and the cleaning cloth comprises a water-seepage area, a decontamination area and a water-absorption area.

* * * * *